United States Patent [19]

DeSantis

[11] Patent Number: 4,905,990

[45] Date of Patent: Mar. 6, 1990

[54] EXERCISE MAT

[76] Inventor: Gabriel J. DeSantis, 816 Hollywood Cir., Cuyahoga Falls, Ohio 44224

[21] Appl. No.: 320,403

[22] Filed: Mar. 8, 1989

[51] Int. Cl.[4] ..... A63K 3/04

[52] U.S. Cl. ..... 272/101; 5/470; 5/466

[58] Field of Search ..... 272/101, 109, 143; 5/417–420, 434, 442, 445, 448, 462, 465, 466, 431, 503

[56] References Cited

U.S. PATENT DOCUMENTS

| | | | |
|---|---|---|---|
| 1,731,530 | 10/1929 | Gordeen et al. | 5/466 |
| 3,489,194 | 1/1970 | Hoover | 5/420 X |
| 4,671,393 | 6/1987 | Rainey | 5/417 X |

FOREIGN PATENT DOCUMENTS

| | | | |
|---|---|---|---|
| 4047796 | 7/1970 | Australia | 5/420 |
| 1407484 | 9/1975 | United Kingdom | 272/109 X |

*Primary Examiner*—Richard J. Apley
*Assistant Examiner*—D. F. Crosby
*Attorney, Agent, or Firm*—Oldham & Oldham Co.

[57] ABSTRACT

An exercise mat assembly comprising an extension pad and a mat body is disclosed. Each comprises a flexible cover, preferably plastic, with flexible padding inside the cover. The mat body is foldable along its transverse axis into two segments. One of these segments has a pocket for storing the extension pad as well as other items such as shoes, containers, and towels. A loop strap sewn to the pocket segment of the mat body at the mid-point of its longitudinal edge thereof, encircles the extension pad loosely enough so that the extension pad may be inserted and removed from the pocket, but tightly enough to hold the extension pad in the appropriate relationship with the mat body during exercise. The extension pad may also be removed from the loop strap and used in spaced relationship with the mat body, thereby allowing the flexibility to adjust the configuration of the extension pad and mat body to conform to differing exercise needs. The exercise mat assembly is also provided with hand straps and a shoulder strap for carrying.

5 Claims, 2 Drawing Sheets

EXERCISE MAT

TECHNICAL FIELD

This invention relates to exercise gear and more particularly to an exercise mat.

BACKGROUND ART

Exercise mats are well known and are widely used in fitness centers and gymnasiums. Basically, a conventional exercise mat is rectangular in shape and comprises a sheet-like cloth or plastic encasement of some form of padding. The usual exercise mat will normally stay in one place, i.e., on the floor of the fitness club or hung on the wall in storage. A disadvantage of the conventional mat is lack of portability and size. The conventional exercise mat is too large and bulky for use when groups are exercising and is not readily folded or compacted for easy transportation.

THE DISCLOSURE OF THE INVENTION

This invention provides a personal exercise mat which is portable and fitted to the needs of an individual who wishes to exercise privately, or as a participant in an exercise class. The dimensions of the mat are sufficient to accommodate the user without the imposition of requiring excessive floor space.

The exercise mat of this invention comprises an assembly of two units, a mat body and an extension pad. The mat body, which comprises two carrying handles and a shoulder strap, is foldable about its transverse axis forming two equal segments. One of these segments has a pocket attached thereto which is designed to accommodate the extension pad. The extension pad is secured to the mat body by means of a loop strap which is fastened to the pocket segment of the mat body. The loop strap loosely encircles the extension pad thereby permitting the extension pad to be slid in or out of the pocket while still secured to the mat body.

BEST MODE FOR CARRYING OUT THE INVENTION

Figure 1:
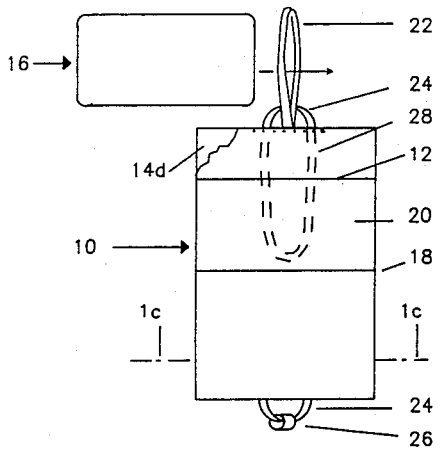
FIG. 1 is a top view of the mat body of an exercise mat assembly according to this invention showing the extension pad to the side before attachment.
Figure 1A:
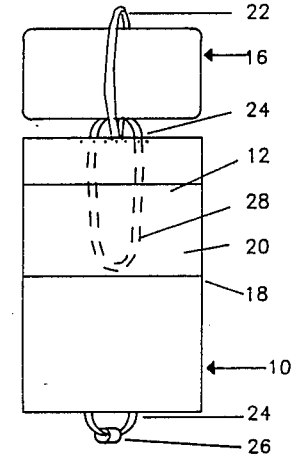
FIG. 1A is a top view of the mat body showing the extension pad attached.
Figure 1B:
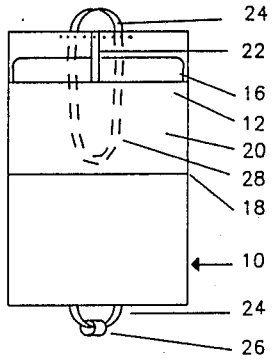
FIG. 1B is a top view of the mat body showing the estension pad inserted into the attached pocket.
Figure 1C:
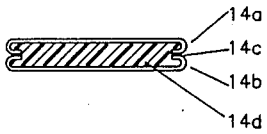
FIG. 1C is a vertical cross sectional view taken along line 1*c*—1*c* of FIG. 1.

The exercise mat of this invention will be described with particular reference to FIGS. 1, 1A, 1B, 1C, 2, 2A, 2B, 2C, and 2D.

Referring now to FIGS. 1, 1A, 1B, and 1C the mat body 10 is generally rectangular in shape and comprises a generally rectangular pocket 12 attached to one-half of the mat body 10. The mat body 10 comprises a pair of cover sheets 14*a* and 14*b* of a plastic or cloth material, as for example plasticized polyvinyl chloride or nylon, which are sewn together along their edges 14*c*, and a padding 14*d*, which is enclosed by covers 14*a* and 14*b*. Padding 14*d* may be of any suitable material used in mats or pillows, as for example foam rubber, sponge rubber, or kapok. Preferably padding 14*d* is of a flexible continuous coherent resilient material such as sponge rubber, foam rubber, or foamed polyurethane. The extension pad 16 is similarly constructed, comprising a sheet-like cover, padding, and a generally rectangular shape.

The mat body 10 is designed to be folded along a fold line 18. The fold line 18 preferably coincides with the transverse center line of the mat body 10. The mat body 10 may be folded along this fold line for carrying as will be hereinafter described.

A flexible rectangular sheet 20 of plastic or cloth is sewn or otherwise joined along three edges thereof to the exterior of the mat body 10, dividing the mat body 10 into two equal segments, so as to form a pocket 12 for receiving the extension pad 16. The fourth edge of the sheet 20 is not joined to the mat body 10, so that the pocket 12 has an opening. The three edges of the sheet 20 which are joined to the mat body 10 are typically one edge which coincides with the fold line 18, and two edges which coincide with the two latitudinal side edges of the mat body 10. Preferably the width of the sheet 20 is slightly less than ½ the length of the mat body 10, so that the fourth edge of the sheet (the edge not joined to the mat body 10) is spaced a short distance from the longitudinal end of the mat body 10, in order to facilitate insertion and removal of the extension pad 16. The materials, construction, and design of the mat body 10 and the extension pad 16 allow the placement of items such as shoes, containers, towels and the like into the pocket 12 in addition to the extension pad 16.

A loop strap 22 is fastened, e.g., by sewing, to the mat body 10 at the midpoint of the longitudinal end that is adjacent to the opening of the pocket 12. The loop strap 22 is preferably sewn to both cover sheets 14*a* and 14*b* along their outer edges 14*c* and is designed to accommodate the extension pad 16 by somewhat loosely encircling it. The design of the loop strap 22 is such that the extension pad 16 may be easily inserted and removed, as may be seen in FIG. 1 and FIG. 1A. The design also insures that the extension pad will stay in place unless purposely removed from the loop strap 22. The tension of the loop strap 22 allows it to slip around the extension pad 16 as it is inserted and removed from the pocket 12.

The mat body 10 also has a hand carrying strap 24 attached to the middle of each longitudinal end, preferably by being sewn to both cover sheets 14*a* and 14*b* along their respective edges 14*c*. These straps enable a person to carry the mat body 10 folded along the fold line 18 with the extension pad 16 inserted into the pocket 12.

A shoulder carrying strap 28 is attached to the hand carrying strap 24 at the longitudinal end of the mat body 10 that coinsides with the opening to the pocket 12. The attachment is made in a special manner so that the shoulder strap 28 will remain underneath the mat body 10 preventing its interferience with the exerciser. The position of shoulder strap 28 underneath the mat body 10 is shown by dashed lines in FIGS. 1, 1A, and 1B.

A loop fastener 26 in the form of a short velcro strap having complimentary hooks and loops may be provided for securing the two hand straps 24 together when the mat body 10 is folded along the fold line 18. The loop fastener 26 may be sewn to one of the two hand straps 24, but is preferably a separate piece that is not attached to any portion of the mat body 10 or the extension pad 16. The loop fastner 26 is particularly useful for holding the mat body 10 in the folded position when articles are stored in the pocket 12.

Figure 2:
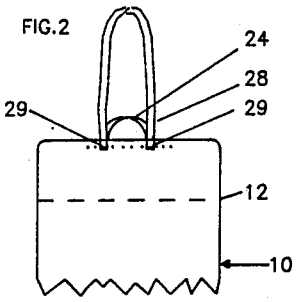
FIG. 2 is a view of the pocket segment of the mat body showing the first step in the attachment of the shoulder strap.
Figure 2A:
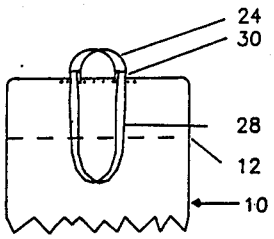
FIG. 2A is a view of the pocket segment of the mat body showing the second step in the attachment of the shoulder strap.
Figure 2B:
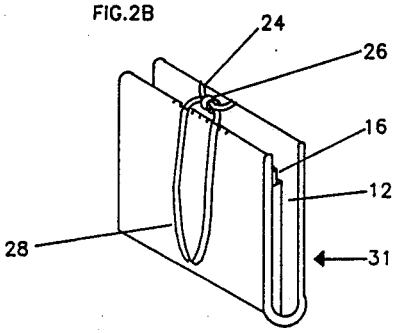
FIG. 2B is a view of the folded mat assembly prepared for carrying by the hand straps.

Referring now to FIGS. 1C, 2, 2A and 2B. The mat body 10 also has a shoulder strap 28 fastened to the hand carrying strap 24 at the longitudinal edged adjacent to the opening of the pocket 12. The attachment of the shoulder strap 28 is made on the side of the hand carrying strap 24 that is opposite the pocket 12 preferably by sewing the ends of the shoulder strap 28 to the hand carrying strap 24 and to both cover sheets **14*a* and 14*b* along their edges 14*c*. The procedure is accomplished in two steps as shown in FIGS. 2 and 2A. The first step aligns the ends of the shoulder strap 28 with the ends of the hand carrying strap 24, where stitching 29 is made to secure the shoulder strap 28 to the hand carrying strap 24. In the second step, the shoulder strap 28 is folded back over its self and a second stitching 30 is made reinforcing the attachment of the shoulder strap 28 to the hand carrying strap 24. This procedure forces the shoulder strap 28, which is in the form of a loop of greater length than the length of the hand carrying straps, to hang downward when the exercise mat assembly is carried by the hand carrying straps 24, as shown in FIG. 2B. It also insures that the shoulder strap 28 will remain under the mat body 10** when the exercise mat is placed in use, preventing it from interfering with the exerciser.

Figure 2C:
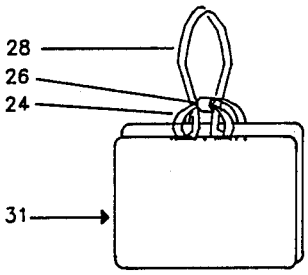
FIG. 2C is a broad side view of the folded mat assembly prepared for carrying by the shoulder strap.
Figure 2D:
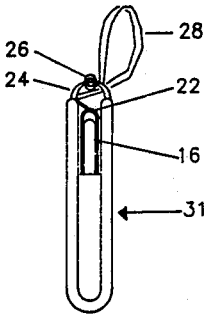
FIG. 2D is a narrow side view of the folded mat assembly prepared for carrying by the shoulder strap.

Referring now to FIGS. 2B, 2C, and 2D. The exercise mat assembly 31 can be held in the closed position through the use of the velcro fastener 26 and/or the shoulder strap 28. The velcro fastener 26 is used by encircling the hand carrying straps 24 and securing the ends of the velcro fastener 26 together by means of the incorporated hook and loop systems. The shoulder strap 28 can be used to hold the exercise mat assembly 31 in the closed position by inserting the shoulder strap 28 through the hand carrying straps 24 and cinching the closure of the exercise mat assembly 31 by pulling upward on the shoulder strap 28. The cinching process is automatically accomplished when the shoulder strap 28 is positioned over the shoulder to transport the exercise mat assembly.

Referring now to FIGS. 1A, 1B, 2B, 2C, and 2D. To use the exercise mat assembly of this invention, the user unfolds the mat body 10 and spreads it out flat on the floor with the extension pad 16 preferably retained in the loop strap 22 and placed just beyond the longitudinal edge of the pocket segment of the mat body 10. When in the supine position, the user's head is accommodated by the extension pad 16, and the user's torso by the mat body 10; the user's legs and feet extent beyond the longitudinal edge of the mat body 10 opposite the extension pad 16. The user can also rearrange the relationship of the extension pad 16 and the mat body 10 to meet the demands of most any exercise. As for example when exercising in the hands and knees position, the user can easily flip the extension pad 16 to a position on top of the mat body 10 to provide double padding for the exerciser's knees.

When exercise is finished, the user slides extension pad 16 into the pocket 12 and folds the mat body 10 along the fold line 18. The loop strap 26 is optionally fastened around the hand carrying straps 24, and the shoulder strap 28 is optionally inserted through the hand carrying straps 24. The exercise mat assembly can then be carried by hand using the hand carrying straps 24 or over the shoulder by using the shoulder strap 28.

The exercise mat assembly of this invention provides a compatible mat body 10 and extension pad 16. The loop strap 22 serves to unitize the mat body 10 with the extension pad 16 so that the latter does not become separated from the former during exercise, while at the same time, providing the flexibility to use each unit separately. The extension pad 16 can be inserted into the pocket 12 without removal from the loop strap 22, and when so inserted, the exercise mat assembly 31 can be easily carried about or stored in a small place, e.g., on a closet shelf. In addition, the exercise mat assembly is durable. It is abrasive resistant and virtually snag proof due to the materials used and construction. The mat will withstand hard use over a long period of time and may be tossed or dropped without harm.

While this description has been provided with reference to specific preferred embodiments thereof, it will be understood that these are by way of illustration and not by way of limitation.

What is claimed is:

1. An exercise mat assembly comprising an extension pad and a mat body, said mat body being foldable about its transverse axis into two equal segments, one of said segments having a pocket attached thereto designed to accommodate said extension pad, and said extension pad being secured to said mat body by a loop strap fastened to the pocket segment of said mat body which loosely encircles said extension pad, thereby permitting said extension pad to be slid in or out of said pocket while still secured to said mat body.

2. An exercise mat assembly according to claim 1, said exercise mat assembly being essentially rectangular.

3. An exercise mat assembly according to claim 1, in which said extension pad and said mat body comprise padding in a sheet covering.

4. An exercise mat assembly according to claim 1, in which said mat body has a hand carrying loop strap attached to each of its longitudinal ends, as well as a shoulder strap attached to the longitudinal end of the pocket segment of the mat body.

5. An exercise mat assembly that can be deployed in a carrying mode, or in a use mode, comprising a mat body with an extension pad loosely attached thereto by means of an encircling loop strap, said carrying mode being achieved by sliding said extension pad into an adjacent pocket forming part of said mat body, thereafter folding said mat body into substantially equal segments about its transverse axis, and securing together hand carrying loop straps located at each of the longitudinal ends of said mat body; said use mode being achieved by reversing the procedure described above.

* * * * *